United States Patent [19]

Juszak

[11] Patent Number: 4,993,752

[45] Date of Patent: Feb. 19, 1991

[54] METHOD OF PRODUCING CORRESPONDENCE

[75] Inventor: Joseph J. Juszak, Crystal Lake, Ill.

[73] Assignee: Wallace Computer Services, Inc., Hillside, Ill.

[21] Appl. No.: 451,779

[22] Filed: Dec. 18, 1989

[51] Int. Cl.[5] ..... B42D 15/00

[52] U.S. Cl. ..... 283/67; 428/40; 283/117

[58] Field of Search ..... 428/40, 57; 283/81, 283/99, 100, 101, 105, 106, 108, 109, 67, 80, 901, 117, 116

[56] References Cited

U.S. PATENT DOCUMENTS

| | | | |
|---|---|---|---|
| 3,104,799 | 9/1963 | Steidinger | 229/69 |
| 3,339,827 | 9/1967 | Steidinger | 229/69 |
| 3,777,971 | 12/1973 | Steidinger | 229/68 R |
| 4,109,936 | 8/1978 | Steidinger | 282/11.5 A |
| 4,272,327 | 6/1981 | Logan | 283/21 |
| 4,428,997 | 1/1984 | Shulman | 428/202 |
| 4,664,416 | 5/1987 | Steidinger | 283/81 |

*Primary Examiner*—Paul A. Bell

*Attorney, Agent, or Firm*—Tilton, Fallon, Lungmus & Chestnut

[57] ABSTRACT

A method of producing correspondence wherein stationery is equipped at a suitable location with a transparent pressure sensitive adhesive-backed label for coincidental typing with the stationery and which is removable thereafter for application to a blank envelope.

2 Claims, 1 Drawing Sheet

METHOD OF PRODUCING CORRESPONDENCE

BACKGROUND AND SUMMARY OF INVENTION:

This invention relates to a method for producing correspondence and more particularly to the use of stationery which carries a removable transparent label for application to an envelope.

When correspondence, i.e., letters, are sent out, it is usually necessary for the typist to separately type the name and address on the envelope. This is not only time consuming—the insertion of the envelope in the typewriter—but also brings about the possibility of error in putting the letter into the wrong envelope.

According to the invention, stationery is provided with a removable transparent label adjacent the upper right hand corner and the typist in addressing the letter merely duplicates the information on the label then when the letter is complete—and signed, if necessary—the now-typed label is removed from the stationary and applied to a blank envelope, the letter folded, inserted and the envelope posted.

Now, the signer of the correspondence merely has a stack of letters in front of him or her for signing without the bulkiness of an envelope for each letter usually paper clipped to the letter.

Other objects and advantages of the invention may be seen in the details of the ensuing specification.

The invention is described in conjunction with an illustrative embodiment in the accompanying drawing, in which FIG. 1 is a top plan view of stationery equipped with a removable label according to the teachings of this invention;

FIG. 2 is a fragmentary sectional view taken along the sight line 2—2 applied to FIG. 1; and FIG. 3 is a schematic representation, i.e., a block diagram, of the steps performed in producing the correspondence.

DETAILED DESCRIPTION

Figure 1:
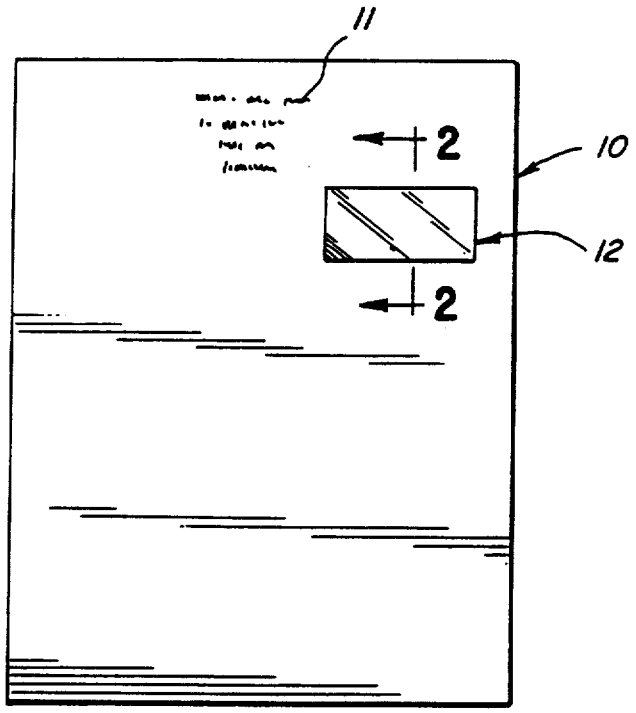

In the illustration given and with reference first to FIG. 1, the numeral 10 designates generally a sheet of stationery (normally $8\frac{1}{2}'' \times 11''$) which advantageously may be equipped with a printed letterhead 11. The numeral 12 designates generally a removable label constructed according to teachings of this invention and which is seen in greater detail in FIG. 2.

Referring now to FIG. 2, the numeral 11 again designates the sheet of stationery and in a position adjacent the upper right hand corner, the sheet 11 is equipped with a coating 13 of release material such as a silicon coating. A label 14 on its underside, i.e., the face in confronting relation with the release coating 13 is equipped with a pressure sensitive adhesive 15 A business form construction having a releasable coating of an analogous nature can be seen in co-owned Pat. No. 4,664,416.

Here, however, the substrate is stationery, normally a rag-containing bond but which is spot coated with release material in the preferred location. The label 14 is advantageously a transparent film which has been treated for ink receptivity and avoidance of the possibility of smudging.

Figure 2:
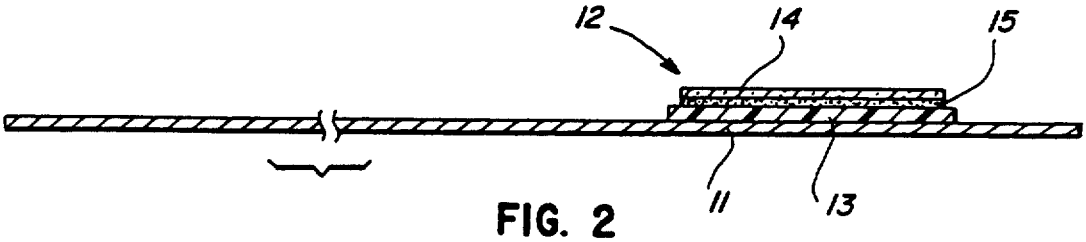
Figure 3:
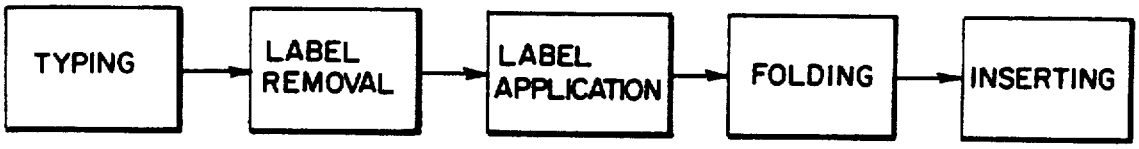

In the practice of the invention (now referring to FIG. 3), the first step involves typing the letter on a stationery sheet of the nature described in connection with FIGS. 1 and 2. This includes typing the name and address adjacent the upper left hand corner and then duplicating the same on the label 15. This normally is a very simple operation because of the widespread use of word processors which can replay for a second location the information which has been set down in a first location.

After the letter has been signed, the label is removed and applied to a blank envelope. Thereafter the now-typed letter is folded and lastly inserted into the envelope which achieves the twin objectives of the invention in the saving of time and the avoidance of error.

The following is a specific example of the invention:

EXAMPLE

For the stationery sheet 10, I provide a bond sheet having 25% rag content and weighing 20 pounds per 500 sheet ream. This stationery is coated with a silicon release coating in the manner described in the abovementioned Pat. No. 4,664,416. Thereafter the label 14 with pressure sensitive adhesive backing is applied and the label 14 is advantageously constructed of cellulose acetate suitably treated for ink receptivity. Such material is conventionally referred to as acetate film. More particularly, the transparent, treated label material 14 is available from Fasson under Catalog No. TTD-89-2650, consisting of 0.0015" thick cellulose acetate. The pressure sensitive adhesive 15 is advantageously an adhesive obtained from Fasson under Catalog No. S246 and the release coating material is obtainable from General Electric Corporation under Catalog No. 9300, 9305 and 9310.

It will be appreciated that considerable variation may be made in the practice of the invention while still obtaining the benefits thereof. For example, the stationery can be imprinted with the letterhead 11 and thereafter and at a different location equipped with the release coating 13. At such a location or a different location, the transparent, adhesive backed label may be applied.

Advantageously, the label 14 may have dimensions of about 70 mm. by 13.5 mm. (about $2\frac{3}{4}'' \times 1\frac{1}{4}''$) and is generally rectangular so that fingernail insertion under a corner for removal is facilitated.

While in the foregoing specification a detailed description of the invention has been set down for the purpose of illustration, many variations in the details hereingiven may be made by those skilled in the art without departing from the spirit and scope of the invention.

I claim:

1. A method of producing correspondence comprising the steps of:

(1) providing a sheet of rectangular stationery having a label position adjacent the upper right portion thereof, a layer of release material on said portion and a generally rectangular transparent label constructed of ink receiving film mounted on said layer and equipped with a pressure sensitive adhesive on the face thereof contacting said release material, (2) typing correspondence information on the stationery and, at the same time, typing the address of the intended recipient on said label, (3) providing an envelope having an unaddressed face, (4) removing said typed label from said stationery and applying it to said unaddressed envelope face, (5) folding said stationery, and (6) inserting the folded stationery into an envelope.

2. The method of claim 1 in which the stationary has a letterhead in the upper central portion thereof, and in which the said step of typing involves typing the name and address of the recipient adjacent the upper left hand corner and then duplicating the same on said label.

* * * * *